United States Patent [19]

Sander

[11] 4,243,167

[45] Jan. 6, 1981

[54] WEB GUIDE SYSTEM

[76] Inventor: Frank Sander, 4744 N. Kenneth, Chicago, Ill. 60630

[21] Appl. No.: 953,951

[22] Filed: Oct. 23, 1978

[51] Int. Cl.[3] ..... B65H 25/26

[52] U.S. Cl. ..... 226/21

[58] Field of Search ..... 226/21, 15, 18, 22, 226/23, 2, 3; 198/840; 74/241; 26/51.3, 51.4, 51.5

[56] References Cited

U.S. PATENT DOCUMENTS

| | | | |
|---|---|---|---|
| 2,513,927 | 7/1950 | Farrington . | |
| 2,654,599 | 10/1953 | Frisbie . | |
| 3,043,153 | 7/1962 | Hindle et al. | 226/21 X |
| 3,073,495 | 1/1963 | Evers . | |
| 3,101,005 | 8/1963 | Mittag . | |
| 3,107,036 | 10/1963 | Richards et al. | 226/22 X |
| 3,254,818 | 6/1966 | Jacobsen . | |
| 3,300,114 | 1/1967 | Jacobsen | 226/21 X |
| 3,373,288 | 3/1968 | Otepka . | |
| 3,380,637 | 4/1968 | Knapp . | |
| 3,436,002 | 4/1969 | Racine | 226/23 |
| 3,489,264 | 1/1970 | Begiebing . | |
| 3,596,817 | 8/1971 | Morse . | |
| 3,615,048 | 10/1971 | Martin . | |
| 3,958,736 | 5/1976 | Pounds | 226/21 X |

FOREIGN PATENT DOCUMENTS

| | | | |
|---|---|---|---|
| 93242 | 3/1922 | Switzerland | 226/21 |
| 1082513 | 9/1967 | United Kingdom | 226/21 |
| 1082514 | 9/1967 | United Kingdom | 226/21 |

*Primary Examiner*—Stanley N. Gilreath

*Attorney, Agent, or Firm*—Laff, Whitesel & Rockman

[57] ABSTRACT

A web guide system to accurately control the lateral alignment of a continuous moving web of material is provided which is efficient and easy to manufacture. A guide roll over which a moving web of material passes in a 90° wrap extends between two pivot arms. The first arm extends downward from a drive motor and is adapted to pivot in a vertical plane about a pivot point on the drive motor. The second arm is adapted to pivot in a vertical plane about a second pivot point offset 90° from the first pivot point in a counterclockwise direction along a quarter circle arc. Movement of the first pivot by the drive motor will cause the guide roll to pivot at an angle from its normal position and shift the lateral position of the moving web of material passing over it. A scanner assembly extends between the pivot arms in close proximity to the guide roll to detect lateral misalignment of the moving web of material.

8 Claims, 3 Drawing Figures

WEB GUIDE SYSTEM

BACKGROUND OF THE INVENTION

This invention relates to a device to control the lateral alignment of a continuous moving web of material and more particularly, to a device to control the lateral alignment of a continuous moving web of material by pivoting a guide roller at an angle to its normal position.

In the printing and stamping arts, among others, certain operations are performed on continuous webs of material which often move through machines at high speed. Accurate alignment of the web is usually required during such operations. However, the moving web often shifts from its proper lateral position on the rollers and guides supporting it, due to imperfections in the web or machinery. Displacement of the web from its true lateral position interferes with the operations being performed on the web and often results in spoilage or a defective product. Prior art devices designed to accurately adjust the lateral position of a continuous web are complicated in construction and entail considerable manufacturing expense. Thus, there is a need for a simple device which is easy to manufacture and can accurately adjust the lateral position of a moving web of material.

Accordingly, a primary object of my invention is to provide a new and improved device to control the lateral alignment of a continuous moving web of material.

Another object of my invention is to provide a device to control the lateral position of a continuous moving web of material by pivoting a guide roller at an angle to its normal position.

A further object of my invention is to provide a device capable of accurately controlling the lateral position of a web of material moving at a high speed.

Still another object of my invention is to provide a device to control the lateral position of a moving web of material which is simple in construction and easy to manufacture.

In the preferred embodiment of my invention; a guide roll is rotatably mounted on a support shaft which extends between two laterally-spaced arms. A continuous moving web of material passes over the guide roll in a 90° wrap. A first pivot arm extends downward from a drive motor and is adapted to rotate in a vertical plane about a pivot point on the drive motor when the motor is actuated. The first pivot arm includes an aperture aligned with the axis of the support shaft and is adapted to receive an end of the support shaft in a loose fit, whereby the support shaft can be pivotally mounted in the aperture for limited pivotal movement. The second pivot arm is adapted to pivot in a vertical plane about a second pivot point offset 90° from the first pivot point. A scanner assembly extends between the two pivot arms in close proximity to the guide roll and is designed to detect lateral misalignment of the moving web of material passing over the guide roll. When misalignment is detected, the scanner assembly activates the drive motor to pivot the guide roll from its position normal to the path of the moving web. The web is thus shifted back into proper lateral alignment.

DETAILED DESCRIPTION OF THE INVENTION

Figure 1:
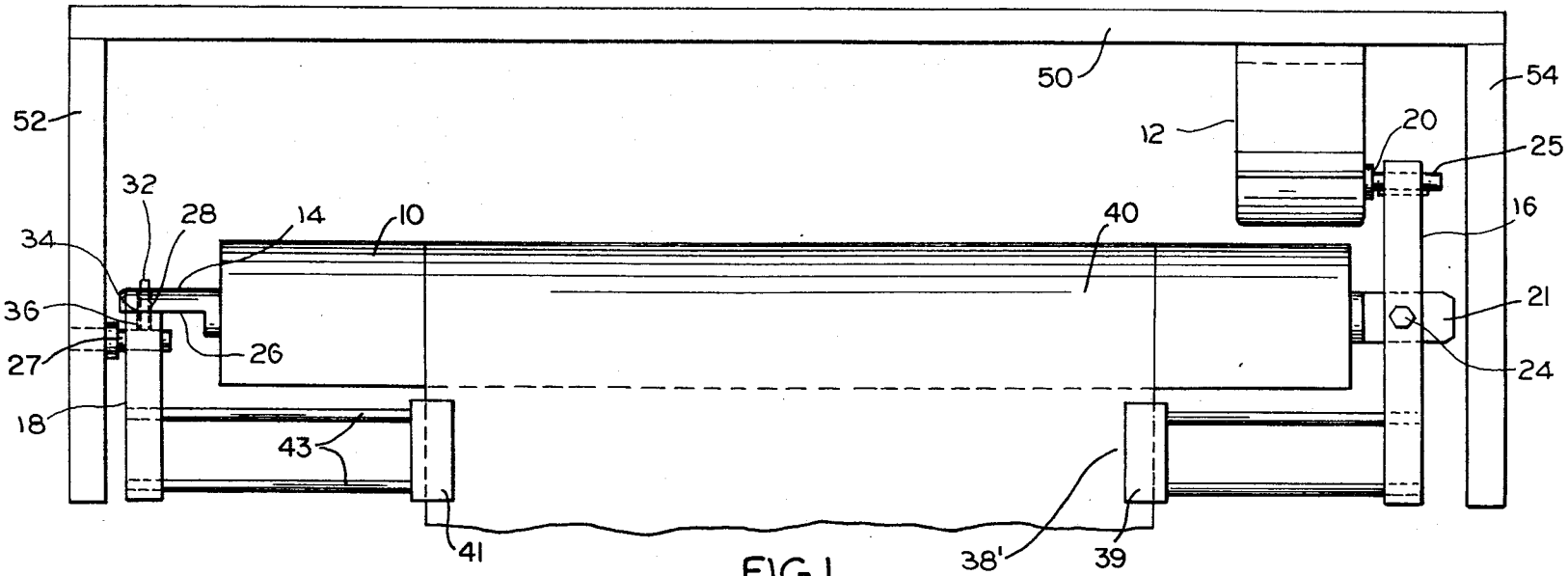
FIG. 1 is a front elevational view of the disclosed invention.
Figure 2:
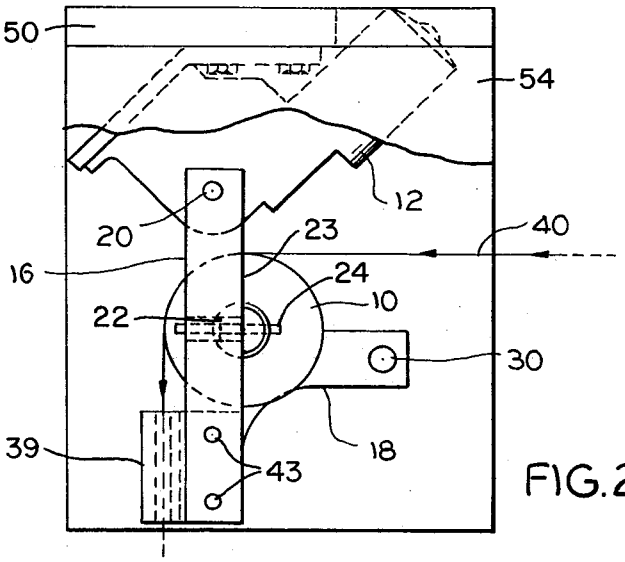
FIG. 2 is a side elevational view from the drive side of the disclosed invention.
Figure 3:
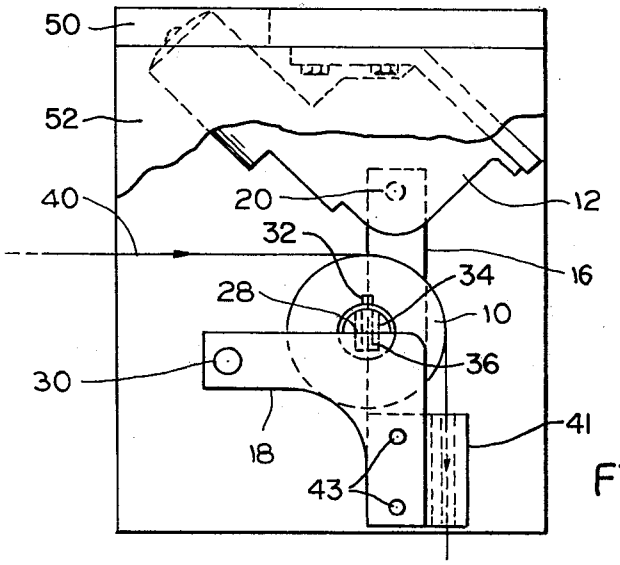
FIG. 3 is a side elevational view of the disclosed invention.

As shown in FIG. 1, a web guide system constructed in accordance with my invention comprises guide roll 10 and drive motor 12, employed to pivot guide roll 10 from its normal position. Chassis or frame 50 has a pair of spaced parallel side plates 52, 54. Mounted on the frame 50 and dependant therefrom is the motor 12, which is positioned adjacent side plate 54.

Guide roll 10 is rotatably supported by shaft 14, which is hinged to pivot arms 16 and 18. Pivot arm 16 extends downward from drive motor 12 and is pivotally connected to motor 12 at pooint 20, whereby it may be pivoted forward or backward by motor 12 about point 20, as shown in FIG. 1.

On the end of shaft 14 opposite pivot arm 18, a bearing surface 21 is formed out of a cross-sectional circular segment of shaft 14 along a diameter of shaft 14. Bearing surface 21 rests adjacent surface 23 of arm 16, which pivots about pivot 20 on pivot shaft 25 in a vertical plane parallel to plate 54. Pin 24 extends through shaft 14 and aperture 22 of arm 16, permitting shaft 14 and roller 10 to pivot about pin 24 in a vertical plane perpendicular to plate 54. Thus, when arm 16 is pivoted, shifting the position of shaft 14, shaft 14 will pivot about pin 24.

On the end of shaft 14 opposite arm 16, a bearing surface 26 is formed out of a cross-sectional circular segment of shaft 14 along a diameter of shaft 14. Bearing surface 26 rests adjacent surface 28 of L-shaped pivot arm 18. Pivot arm 18 pivots on pivot shaft 27, which depends from plate 52 at point 30, in a vertical plane parallel to plate 52. The axis of pivot shaft 27 is offset 90° from the axis of pivot shaft 25 in a counterclockwise direction along a quarter circle arc.

Pin 32 extends through aperture 34 in shaft 14 and aperture 36 of arm 18, permitting shaft 14 and roller 10 to pivot about pin 32 in a horizontal plane perpendicular to plate 52. Thus, when arm 16 is pivoted by motor 12 through a small arc, shifting the vertical and horizontal position of shaft 14 and roller 10, shaft 14 can pivot freely about pin 32 and arm 18 can pivot about point 30.

Scanner assembly 38 comprises scanner units 39 and 41 supported by rods 43 which extend between arms 16 and 18. Scanner units 39 and 41 are conventional electric eye apparatus which comprise a light source and a light-sensitive voltage cell. The scanner assembly 38 moves as a unit with guide roller 10.

In operation, web 40 runs over guide roller 10 in a 90° wrap and passes through scanner units 39 and 41 of assembly 38. When the web shifts its lateral position and becomes misaligned, the electric eye of either unit 39 or 41 will be activated depending on whether the web 40 shifts to the right or the left. Drive motor 12 is activated by the scanner unit and arm 16 is then pivoted either forward or backward, depending on whether the web has shifted to the right or left, causing shaft 14 and roller 10 to move either forward or backward on the drive side of the system while pivoting about pin 32 on arm 18. Shifting the horizontal and vertical position of guide roll 10 will cause web 40 to shift laterally on guide roll 10 to the right or left, depending on whether arm 16 is pivoted forward or backward. Hence, in this manner, misalignment of moving web 40 is compensated for by shifting web 40 back into its proper lateral position. When the web returns to its proper position, scanner assembly 38 will deactivate drive motor 12 and return guide roll 10 to its original position to accomodate the shift in position of shaft 14.

While the principles of my invention have been described above in connection with specific embodiments and applications, it is to be understood that this description is made only by way of example and not as a limitation on the scope of the appended claims.

I claim:

1. A web guide system to control the lateral alignment of a continuous moving web of material comprising a drive motor means; a first arm means mounted at one end on a first pivot point located on said drive motor means and extending downward from said drive motor means, said first arm means pivoting in a first vertical plane about said first pivot point when said drive motor is activated; a second arm means mounted on a second pivot point laterally spaced from said first pivot point, said second arm means being L-shaped, with a first leg aligned parallel to said first arm means in said first vertical plane and a second leg aligned perpendicular to said first leg, said second arm means being adapted to pivot about said second pivot point located at the outer extremity of said second leg in a second vertical plane spaced parallel to said first vertical plane; guide roll means over which said moving web of material passes in a 90° wrap; support shaft means upon which said guide roll is rotatably mounted, said support shaft means extending between said first and second arm means, one end of said support shaft pivotally mounted on said first arm means, and the opposite end pivotally mounted on said second arm means, whereby pivoting movement of said first arm means responsive to said drive motor means will cause the end of said support shaft mounted on said first arm means to move over an arc in said first vertical plane and the opposite end of said support shaft pivotally mounted on said second arm to move over an arc in said second vertical plane, shifting the lateral position of said web of material moving over said guide roll; scanner means extending between said first and second arm means to detect lateral misalignment of said moving web of material and to activate said drive motor means when lateral misalignment of said web is detected.

2. The web guide system of claim 1 wherein a bearing surface is formed on the end of said support shaft means opposite said first arm means, whereby said bearing surface rests adjacent said second leg of said L-shaped second arm means.

3. The web guide system of claim 2 wherein said bearing surface is formed from a cross-sectional circular segment along a diameter of said support shaft means.

4. The web guide system of claim 3 wherein a bearing surface is formed on the end of said support shaft means opposite said second arms means, whereby said bearing surface rests adjacent said first arm means.

5. The web guide system of claim 4 wherein said bearing surface is formed from a cross-sectional circular segment along a diameter of said support shaft means.

6. The web guide system of claim 5 wherein said guide roll means is pivotally mounted on said first and second arm means by pin means extending through said bearing surfaces formed on opposite ends of said support shaft means and through surfaces of said first and second arm means adjacent to said bearing surfaces.

7. The web guide system of claim 6 wherein said drive motor means depends from a frame, said frame having a pair of spaced parallel side plates.

8. The web guide system of claim 7 wherein the first of said spaced parallel side plates is positioned adjacent said drive motor means and said second pivot point is located on the second of said spaced parallel side plates.

* * * * *